US009341317B2

(12) United States Patent
Moon et al.

(10) Patent No.: US 9,341,317 B2
(45) Date of Patent: May 17, 2016

(54) LED BULB EMITTING LIGHT RAY IN A DOWNWARD DIRECTION AND MANUFACTURING METHOD THEREOF

(71) Applicant: DONG GUAN NATIONAL STATE LIGHTING CO., LTD, DongGuan, GuangDong (CN)

(72) Inventors: Daisung Moon, Hong Kong (HK); Sangpil Moon, Hong Kong (HK)

(73) Assignee: DONG GUAN NATIONAL STATE LIGHTING CO., LTD., Dongguan (CN)

( * ) Notice: Subject to any disclaimer, the term of this patent is extended or adjusted under 35 U.S.C. 154(b) by 320 days.

(21) Appl. No.: 14/001,672

(22) PCT Filed: Jul. 22, 2013

(86) PCT No.: PCT/CN2013/079801
§ 371 (c)(1),
(2) Date: Aug. 26, 2013

(87) PCT Pub. No.: WO2015/010236
PCT Pub. Date: Jan. 29, 2015

(65) Prior Publication Data

US 2015/0022073 A1 Jan. 22, 2015

(51) Int. Cl.

| | |
|---|---|
| ***F21K 99/00*** | (2010.01) |
| ***F21V 19/00*** | (2006.01) |
| *F21V 3/00* | (2015.01) |
| *F21Y 101/02* | (2006.01) |
| *F21Y 111/00* | (2016.01) |

(52) U.S. Cl.
CPC ..... *F21K 9/1355* (2013.01); *F21K 9/90* (2013.01); *F21V 19/003* (2013.01); *F21V 3/00* (2013.01); *F21Y 2101/02* (2013.01); *F21Y 2111/001* (2013.01)

(58) Field of Classification Search
CPC ..... F21K 9/90; F21K 9/1355
See application file for complete search history.

(56) References Cited

U.S. PATENT DOCUMENTS

| | | | | |
|---|---|---|---|---|
| 2011/0210657 | A1* | 9/2011 | Paik | F21K 9/135 313/46 |
| 2011/0273072 | A1* | 11/2011 | Oki | F21K 9/135 313/46 |
| 2012/0170262 | A1* | 7/2012 | Hoetzl | F21V 29/004 362/227 |
| 2012/0236573 | A1* | 9/2012 | Yamamoto | F21V 25/02 362/311.02 |
| 2012/0293057 | A1* | 11/2012 | Yamamoto | F21V 29/004 313/45 |

FOREIGN PATENT DOCUMENTS

CN 201020606845.2 6/2011

* cited by examiner

*Primary Examiner* — Elmito Breval

(57) ABSTRACT

The present invention relates to a LED bulb emitting light ray in a downward direction and a manufacturing method thereof. The LED bulb emitting light ray in a downward direction comprises a screw head, a base, a lamp body, and a lampshade integrally connected in order, wherein a PCB board longitudinally arranged within the base is fixedly connected with a PCB board transversely arranged on the top of the lamp body, the bottom of a LED aluminum substrate component is fixed by a base buckle, the LED aluminum substrate component is longitudinally fixed on the lamp body by fastening a hook buckle to a buckle hole of the base, the top of the LED aluminum substrate component is fixedly connected with the PCB board on the top of the lamp body, the PCB board on the top of the lamp body is connected with the lamp body by fastening element.

2 Claims, 2 Drawing Sheets

LED BULB EMITTING LIGHT RAY IN A DOWNWARD DIRECTION AND MANUFACTURING METHOD THEREOF

FIELD OF THE INVENTION

The present invention relates to a LED bulb, more particularly to a LED bulb emitting light ray in a downward direction and a manufacturing method thereof.

BACKGROUND OF THE INVENTION

Chinese patent application No. 201020606845.2 has disclosed an Omni-directional LED lamp, aiming to provide an Omni-directional LED lamp emitting Omni-directional lights and having good heat dissipating performance. The technical solution of the application is as following: An Omni-directional LED lamp comprising a lamp cap (1) connected with power source, a plastic shell (2) connected with the lamp cap, a driving power panel (3) arranged in the plastic shell and a lamp body (6), wherein the lamp body further comprises a base (61) fixedly connected with the plastic shell and a plurality of U shape heat sinks (62) mounted on the base in a vertical position, each heat sink has a groove (611) on the outer side for accommodating first U shape aluminum substrate (63), a plurality of LED lamp beads (64) are mounted on the first aluminum substrate, and each U shape heat sink is fixedly connected with a first U shape lampshade (65) on the outer side, accordingly. However, this Omni-directional LED lamp has disadvantages as following: since the LED lamp beads are packaged in the U shape heat sink and lamp shade, a lot of heat generated in operation cannot be dissipated in time and will cause the sealed cavity of the LED lamp beads to overheat.

Moreover, traditional bulbs emitting light ray in a downward direction use reflectors or lens and consume too much light ray, so these bulbs need 10%~15% more LED in structural design.

SUMMARY OF THE INVENTION

The present invention aims to provide a LED bulb emitting light ray in a downward direction, erecting the LED aluminum substrate, instead of laying it flat, as a sealed loop and making it stretch into the bulb, having the advantages of good uniformity of emergent light, good heat dissipation, compact shape and easy assembly. The present invention also aims to provide a method of manufacturing a LED bulb emitting light ray in a downward direction.

The present invention provides the following technical solutions. A LED bulb emitting light ray in a downward direction and comprising a screw head, a base, a lamp body, and a lampshade integrally connected in order, characterized in that: the lampshade is connected by a hook buckle with the lamp body mounted on the base, a PCB board longitudinally arranged within the base is fixedly connected with a PCB board transversely arranged on the top of the lamp body, the bottom of a LED aluminum substrate component longitudinally arranged and covering the lamp body is fixed by a base buckle, the LED aluminum substrate component is fixed on the lamp body by fastening a hook buckle convexly arranged on the bottom of the base buckle to a buckle hole of the base, the top of the LED aluminum substrate component is fixedly connected with the PCB board on the top of the lamp body, the PCB board on the top of the lamp body is connected with the lamp body by fastening element.

Preferably, the lamp body is composed of a heat dissipation cup, a bottom cylinder fixedly arranged on the top of the heat dissipation cup, a top cylinder convexly arranged along the bottom cylinder and having a decreasing diameter, a through hole longitudinally extending through the bottom cylinder and top cylinder for allowing the bottom PCB board to go through it, a screw hole next to the through hole for receiving a screw and a buckle groove concavely arranged at the side wall of the bottom cylinder for receiving the hook buckle of the base buckle.

Preferably, the LED aluminum substrate component is composed of a closed-loop formed of several aluminum substrates connected head to tail, plug tenons molded at the top of each aluminum substrate and several LED lamps arranged on the aluminum substrate.

Preferably, the base buckle is composed of a loop, at least two or more than two hook buckles convexly arranged at the bottom of the loop and several slots longitudinally convexly arranged at the inner wall of the loop for plug-in mounting and fixing the bottom of each aluminum substrate.

Preferably, the PCB board on the top of the lamp body is composed of tenon slots arranged on the board body in an annular for fastening plug tenons of several aluminum substrates, a hole arranged corresponding to the position of the through hole of the lamp body, a screw hole next to the hole for receiving a screw and several LEDs arranged on the board body.

Preferably, the base PCB board is connected with the PCB board on the top of the lamp body by tin soldering; the top of the LED aluminum substrate component is connected with the PCB board on the top of the lamp body by tin soldering.

The present invention also provides another technical solution as follow. A manufacturing method of the LED bulb emitting light ray in a downward direction, characterized by comprising the following steps:

(1) connecting a base to a screw head by screwing;

(2) mounting a lamp body on the base, pushing a PCB board longitudinally arranged within the base through a through hole of a lamp body, and fixedly connecting the base PCB board with a PCB board on the top of the lamp body;

(3) fixing, by slots on the inner wall of a loop of a base buckle, the bottom of a LED aluminum substrate component longitudinally arranged between the lamp body and the PCB board on the top of the lamp body and covering the lamp body;

(4) plugging plug tenons molded at the top of aluminum substrates into tenon slots of the PCB board on the top of the lamp body, and fixedly connecting the top of the LED aluminum substrate component with the PCB board on the top of the lamp body;

(5) fixing the base buckle to the lamp body by slipping a hook buckle convexly arranged on the bottom of the base buckle over a buckle groove concavely arranged at the side wall of a bottom cylinder of the lamp body and fastening it into a buckle hole of the base;

(6) fixedly connecting the PCB board on the top of the lamp body with the lamp body by a screw;

(7) connecting a lampshade to the lamp body by a hook buckle.

Compared with the prior art, the present invention has advantages as following:

(1) Since the LED bulb emitting light ray in a downward direction has a longer lamp body inserted inside the lampshade, it is easy to assemble the LED aluminum substrate and good for heat dissipation, and it obtains good heat dissipation effect.

(2) It uses less LED to obtain same light intensity as more traditional LED.

(3) Since the LED aluminum substrates are erected as a sealed loop and stretched into the bulb, it has good uniformity of emergent light.

(4) The LED bulb emitting light ray in a downward direction is smaller and convenient to assemble.

Figure 1:
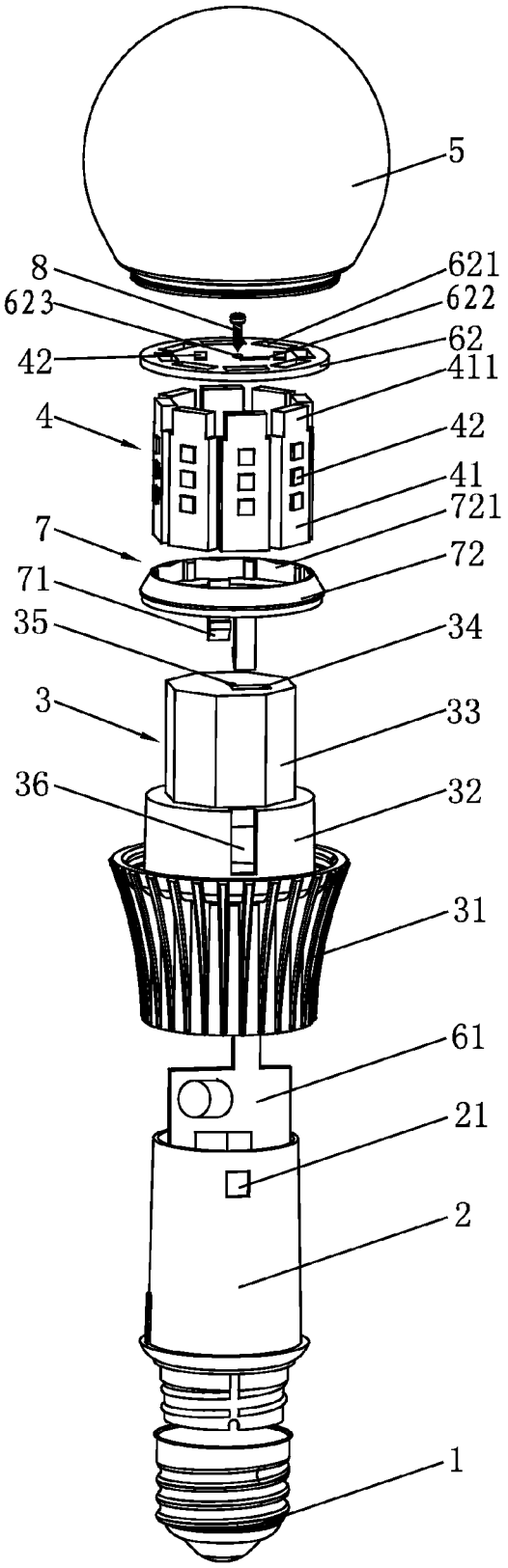
FIG. 1 is an exploded view of the LED bulb emitting light ray in a downward direction of the present invention.

List of reference numerals of main components: screw head 1, base 2, buckle hole 21, lamp body 3, heat dissipation cup 31, bottom cylinder 32, top cylinder 33, through hole 34, screw hole 35, buckle groove 36, LED aluminum substrate component 4, aluminum substrate 41, plug tenon 411, LED 42, lampshade 5, bottom PCB board 61, top PCB board 62, tenon slot 621, hole 622, screw hole 623, base buckle 7, hook buckle 71, loop 72, slot 721, screw 8.

DETAILED DESCRIPTION OF ILLUSTRATED EMBODIMENTS

Figure 2:
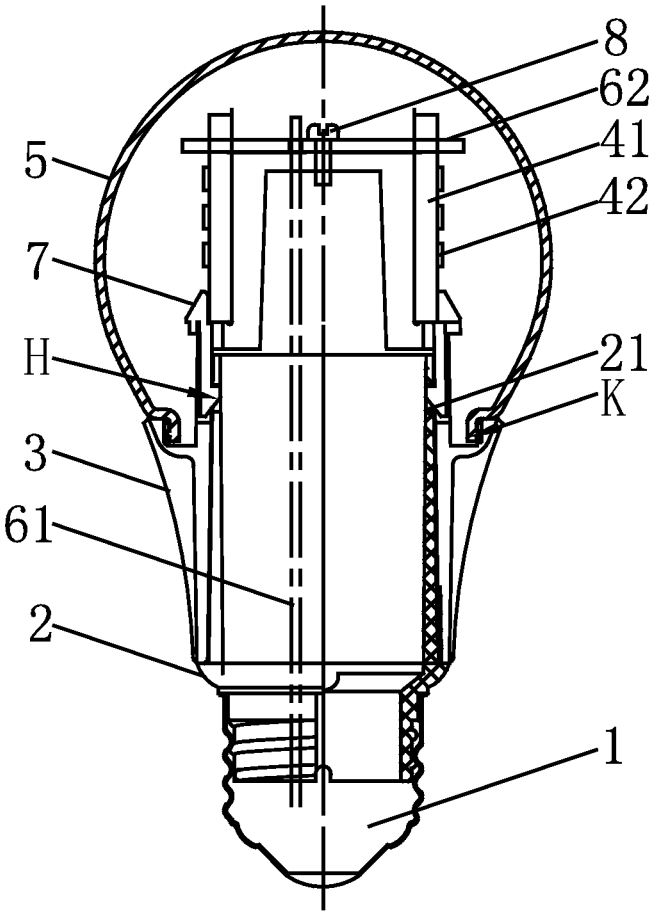
FIG. 2 is a sectional view of the assembling of the LED bulb emitting light ray in a downward direction of the present invention.

Various preferred embodiments will now be described with reference to the figures. As shown in FIG. 1, the LED bulb emitting light ray in a downward direction comprises a screw head 1, a base 2 connected to the screw head 1 by screwing, a PCB board 61 longitudinally arranged within the base 2 and connected with the PCB board 62 on the top of the lamp body by tin soldering, a lamp body 3 mounted on the base 2, and the bottom of the LED aluminum substrate component 4 longitudinally arranged at the PCB board 62 on the top of the lamp body 3 and covering the lamp body 3 is fixed by a base buckle 7, the LED aluminum substrate component 4 is fixed to the lamp body 3 by fastening the hook buckle 71 convexly arranged on the bottom of the base buckle 7 to a buckle hole 21 of the base (referring to H shown in FIG. 2), the top of the LED aluminum substrate component 4 is connected with the PCB board 62 on the top of the lamp body by tin soldering, the PCB board 62 on the top of the lamp body 3 is connected with the lamp body 3 by a screw 8, a lampshade 5 is connected to the lamp body 3 by a hook buckle (referring to K shown in FIG. 2).

In the embodiment, the lamp body 3 is composed of a heat dissipation cup 31, a bottom cylinder 32 fixedly arranged on the top of the heat dissipation cup 31, a top cylinder 33 convexly arranged along the bottom cylinder 32 and having a decreasing diameter, a through hole 34 longitudinally extending through the bottom cylinder 32 and top cylinder 33 for allowing the bottom PCB board 61 to go through it, a screw hole 35 next to the through hole 34 for receiving a screw 8 and a buckle groove 36 concavely arranged at the side wall of the bottom cylinder 32 for receiving the hook buckle 71 of the base buckle.

In the embodiment, the LED aluminum substrate component 4 is composed of a closed-loop formed of several aluminum substrates 41 connected head to tail, plug tenons 411 molded at the top of each aluminum substrate 41 and several LEDs 42 arranged on the aluminum substrate 41.

In the embodiment, the base buckle 7 is composed of a loop 72, two hook buckles 71 symmetrically and convexly arranged at the bottom of the loop 72 and several slots 721 longitudinally convexly arranged at the inner wall of the loop 72 for plug-in mounting and fixing the bottom of each aluminum substrate 41.

In the embodiment, the PCB board 62 on the top of the lamp body 3 is composed of tenon slots 621 arranged on the board body in an annular for fastening plug tenons 411 of several aluminum substrates 41, a hole 622 arranged corresponding to the position of the through hole 34 of the lamp body, a screw hole 623 next to the hole 622 for receiving a screw 8 and several LEDs 42 arranged on the board body.

The manufacturing method of the LED bulb emitting light ray in a downward direction comprises the following steps:

(1) connecting a base 2 to a screw head 1 by screwing;

(2) mounting a lamp body 3 on the base 2, pushing a PCB board 61 longitudinally arranged within the base 2 through a through hole 34 of a lamp body 3, and connecting the base PCB board 61 with a PCB board 62 on the top of the lamp body by tin soldering;

(3) fixing, by slots 721 on the inner wall of a loop 72 of a base buckle, the bottom of the LED aluminum substrate component 4 longitudinally arranged between the lamp body 3 and the PCB board 62 on the top of the lamp body and covering the lamp body 3; plugging plug tenons 411 molded at the top of aluminum substrates 41 into tenon slots 621 of the PCB board on the top of the lamp body 3, and connecting the top of the LED aluminum substrate component 4 with the PCB board 62 on the top of the lamp body 3 by tin soldering;

(4) fixing the base buckle 7 to the lamp body 3 by slipping a hook buckle 71 convexly arranged on the bottom of the base buckle over a buckle groove 36 concavely arranged at the side wall of a bottom cylinder 32 of the lamp body 3 and fastening it into a buckle hole 21 of the base;

(5) fixedly connecting the PCB board 62 on the top of the lamp body with the lamp body 3 by a screw 8;

(6) connecting a lampshade 5 to the lamp body 3 by a hook buckle.

All the above are the preferred embodiments of the present invention, and the invention is intended to cover various modifications and equivalent arrangements included within the scope of the invention.

What is claimed is:

1. A LED bulb emitting light ray in a downward direction and comprising a screw head, a base, a lamp body, and a lampshade integrally connected in order, characterized in that: the lampshade is connected by a hook buckle with the lamp body mounted on the base, a PCB board longitudinally arranged within the base is fixedly connected with a PCB board transversely arranged on the top of the lamp body, the bottom of a LED aluminum substrate component longitudinally arranged and covering the lamp body is fixed by a base buckle, the LED aluminum substrate component is fixed on the lamp body by fastening a hook buckle convexly arranged on the bottom of the base buckle to a buckle hole of the base, the top of the LED aluminum substrate component is fixedly connected with the PCB board on the top of the lamp body, the PCB board on the top of the lamp body is connected with the lamp body by fastening element;

wherein the lamp body is composed of a heat dissipation cup, a bottom cylinder fixedly arranged on the top of the heat dissipation cup, a top cylinder convexly arranged along the bottom cylinder and having a decreasing diameter, a through hole longitudinally extending through the bottom cylinder and top cylinder for allowing the bottom PCB board to go through it, a screw hole next to the through hole for receiving a screw and a buckle groove concavely arranged at the side wall of the bottom cylinder for receiving the hook buckle of the base buckle;

wherein the LED aluminum substrate component is composed of a closed-loop formed of several aluminum substrates connected head to tail, plug tenons molded at the top of each aluminum substrate and several LED lamps arranged on the aluminum substrate;

wherein the base buckle is composed of a loop, at least two or more than two hook buckles convexly arranged at the bottom of the loop and several slots longitudinally convexly arranged at the inner wall of the loop for plug-in mounting and fixing the bottom of each aluminum substrate;

wherein the PCB board on the top of the lamp body is composed of tenon slots arranged on the board body in an annular for fastening the plug tenons of several aluminum substrates, a hole arranged corresponding to the position of the through hole of the lamp body, a screw hole next to the hole for receiving the screw and several LEDs arranged on the board body;

the base PCB board is connected with the PCB board on the top of the lamp body by tin soldering; the top of the LED aluminum substrate component is connected with the PCB board on the top of the lamp body by tin soldering.

2. A manufacturing method of the LED bulb emitting light ray in a downward direction according to claim 1, characterized by comprising the following steps:

(1) connecting the base to the screw head by screwing;

(2) mounting the lamp body on the base, pushing the PCB board longitudinally arranged within the base through the through hole of the lamp body, and fixedly connecting the base PCB board with the PCB board on the top of the lamp body;

(3) fixing, by the slots on the inner wall of the loop of the base buckle, the bottom of the LED aluminum substrate component longitudinally arranged between the lamp body and the PCB board on the top of the lamp body and covering the lamp body;

(4) plugging the plug tenons molded at the top of the aluminum substrates into the tenon slots of the PCB board on the top of the lamp body, and fixedly connecting the top of the LED aluminum substrate component with the PCB board on the top of the lamp body;

(5) fixing the base buckle to the lamp body by slipping the hook buckle convexly arranged on the bottom of the base buckle over the buckle groove concavely arranged at the side wall of the bottom cylinder of the lamp body and fastening it into the buckle hole of the base;

(6) fixedly connecting the PCB board on the top of the lamp body with the lamp body by the screw;

(7) connecting the lampshade to the lamp body by a hook buckle.

* * * * *